US005326265A

United States Patent [19]

Prevou

[11] Patent Number: 5,326,265

[45] Date of Patent: Jul. 5, 1994

[54] BATTLEFIELD REFERENCE MARKING SYSTEN SIGNAL DEVICE

[76] Inventor: J. Michael Prevou, 1313 N. Glen Dr., Chattanooga, Tenn. 37343

[21] Appl. No.: 13,710

[22] Filed: Feb. 4, 1993

[51] Int. Cl.[5] ..... F41A 33/00

[52] U.S. Cl. ..... 434/11; 40/604; 40/612

[58] Field of Search ..... 434/11, 27, 16, 19, 434/21; 40/903, 612, 499, 603, 604; 160/10

[56] References Cited

U.S. PATENT DOCUMENTS

| | | | |
|---|---|---|---|
| D. 262,131 | 12/1981 | Dulude | D22/113 |
| D. 262,482 | 12/1981 | Dulude | D11/113 |
| D. 262,819 | 1/1982 | Dulude | D22/113 |
| D. 269,631 | 7/1983 | Dulude | D22/113 |
| 2,075,401 | 3/1937 | Mosby | 40/603 |
| 3,182,414 | 5/1965 | Snediker | 40/604 |
| 3,914,879 | 10/1975 | Taylor, III et al. | 434/19 |
| 4,260,160 | 4/1981 | Ejnell et al. | 273/408 |
| 4,422,646 | 12/1983 | Rosa | 273/348 |
| 4,875,302 | 10/1989 | Noffsinger | 40/603 |
| 4,885,857 | 12/1989 | Leflet | 40/533 |

*Primary Examiner*—Gene Mancene
*Assistant Examiner*—Jeffrey A. Smith

[57] ABSTRACT

A combat training, targeting, and signaling device generally rectangular and planar in shape and containing peripheral grommets allowing for the suspension of the device between two roughly vertical objects, one flat planar surface being a larger piece of brightly colored flexible fabric, to which is attached a smaller piece of a second type of flexible infrared reflective material. The second material is of a sharply contrasting color to its brightly colored background, is of a predetermined shape, and is a material which, without an independent source of power, reflects infrared wavelengths when observed through military sighting devices. The second flat planar surface contains a rear flap assembly pivotally mounted which, when rotated, displays either of two different signaling media, such as either of two types of camouflage, and which after pivoting seals around the periphery of the rear flap assembly using hook-and-loop fasteners, and which rear flap assembly also contains grommets for the additional securing of the entire signaling device between two appropriate vertical objects.

1 Claim, 5 Drawing Sheets

BATTLEFIELD REFERENCE MARKING SYSTEN SIGNAL DEVICE

I. BACKGROUND - FIELD OF INVENTION

Figure 1:
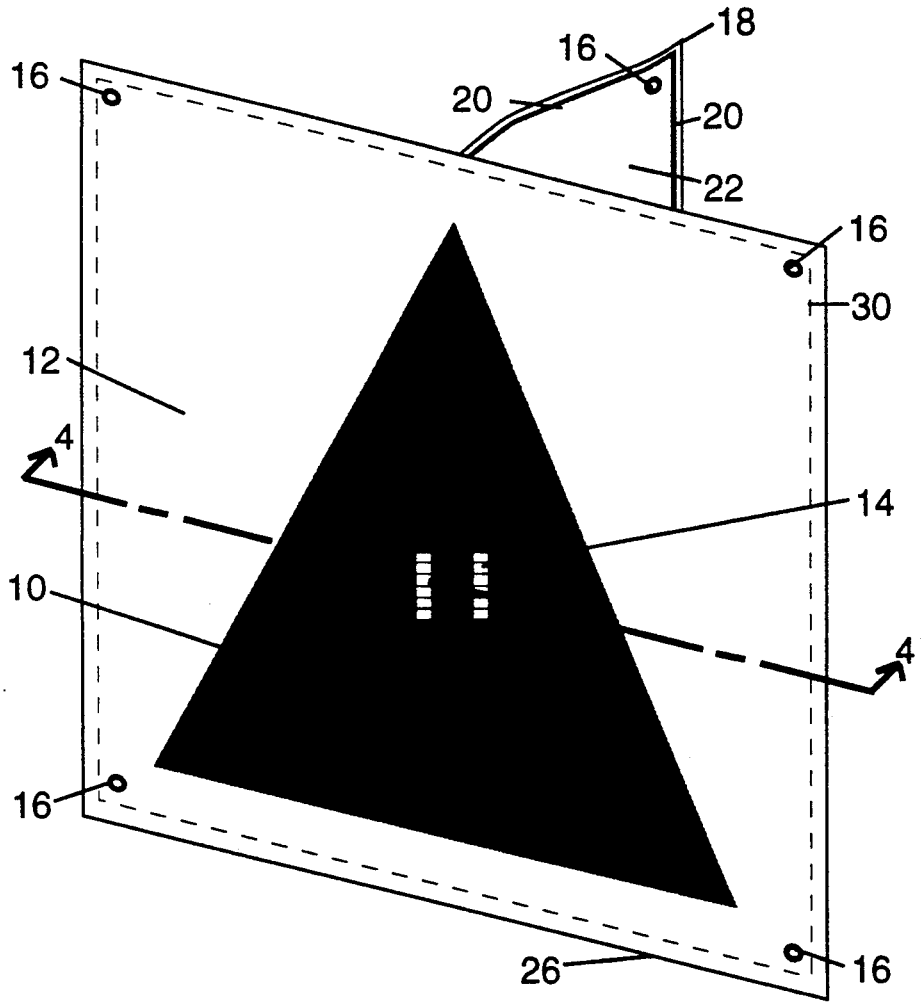

This invention relates to combat information management and to systems used on the battlefield to signal Information, and specifically assists in identification of targets with the subsequent assignment of such targets for destruction to appropriate friendly personnel.

II. BACKGROUND - PRIOR BATTLEFIELD SITUATION

A. In a battlefield situation, whether real or in practice, a commander of forces must, in order to maximize combat efficiency, identify potential targets early and assign such targets to appropriate personnel for destruction. In order to do this, information regarding the potential target must be processed as soon as the target presents itself. This information is comprised among other things of the potential target's size, speed, direction, and geographic location.

B. A target usually first manifests itself as a distant physical object. Assuming that a target has been identified as such and has been selected for destruction, the target must be located in relation to a set of identifiable references, which the commander and the destruction personnel can mutually agree upon. My battlefield reference marker provides assistance in making these determinations.

C. Commanders typically assign fields of fire to fire teams. Within that field of fire, the fire team would identify any mutually convenient reference markers, and destroy targets by referencing target location to such markers.

1. For example, in the field of fire, the target (i.e. tank/vehicle) is related to a mutually agreed upon reference (i.e. large oak/burning drum). A commander may order Company Alpha to destroy all targets between the large oak tree and the barn. In this case, the large oak tree and the barn become the reference points to which the targets are referred.

III. BACKGROUND - LIMITATIONS ON THE STATUS QUO

The existing method of target allocation has been subject to a number of limits:

A. Heretofore, ground forces have used any readily available physical object as such references, so long as the physical object had characteristics sufficient for mutual identification by friendly forces. The availability (if any) and type of these "reference markers" have been left largely to chance.

B. In addition, after the combat fire sequence has been initiated, commanders continue to use random, readily available physical objects for targeting reference points. This may cause battlefield confusion and delay while appropriate reference points are chosen, and while the new reference information is conveyed to the fire teams.

C. Field commanders are often forced to use as reference points a random sampling of objects which happen to be available to them on the battlefield, such as burning drums of combustible materials, burning vehicles, trees (whether burning or not), and other such stationary objects which 1 end themselves readily visible to targeting personnel. The main physical characteristics of the reference point have been whatever physical manifestation best presents itself to friendly forces in a pre-combat or combat situation. The preferred selection of reference points is based on physical size, color, and/or a heat signature.

D. An additional problem arises when a field commander attempts to pre-position a range marker of their own device, instead of relying on the random availability of natural or man-made objects already on the battlefield. Until now, the physical characteristics of the object chosen are sufficient to alert enemy forces of the fact that they are entering an area in which they would be targeted. Time limits and the lack of immediately available resources may force a commander to place an unusually large or colorful impromptu range marker in a manner which is incongruous to the terrain. Enemy forces, still at a distance and out of range, could detect such markers as being "out of place", and would be alerted to the possibility that they may soon become targets. The benefit of surprise would be lost to friendly commanders, and my battlefield reference marker is specifically designed to prevent detection by enemy forces until they are well within range.

E. Any reference point must be easily identifiable and seen by the naked eye or through the current generation of weapons sights, comprised of a number of magnification spotting systems. If the battle occurs at night or the field of direct vision is occluded by gas, dust or other opaque material, targets can be identified by heat signature through thermal sights or light intensifying devices. My battlefield reference marker improves on this haphazard method of selecting reference points, and satisfies the observation needs of friendly forces, thereby improving training and combat efficiency, and preventing errors and fratricide. So long as there is no solid physical object interfering with or interposed between my device and the viewer, then my device will be able to be detected under all conditions, more rapidly and reliably.

IV. ANTICIPATED COMBAT CONDITIONS

A. For the purposes of using my battlefield reference marker as a visible reference point, the battle will occur in four conditions:

Day - clear
Day - occluded
Night - clear
Night - occluded

B. Dusk or dawn have minimal effect on the combatants in terms of Identification of my new range markers for targeting assistance. The combatants merely presume the worse of the available conditions, and adjust accordingly by switching to assisted viewing.

V. BATTLEFIELD EFFICIENCY

A. Rarely will a field commander be able to find an immediately available physical object which is easily recognized by all allied forces and which adequately allows them to draw a reference to a target under these conditions. Therefore, a commander must designate multiple and redundant reference points, perhaps even in the heat of combat. This is an activity which takes time, time which the commander could be using on other more important life saving matters. Saving time in the targeting process, thereby improving overall battlefield efficiency, requires the available reference markers to also be identifiable under all combat conditions.

These inefficiencies have been eliminated by my battlefield reference marker.

B. Efficiency is increased if the commander is able to achieve a higher number of first shot kills than before. Increasing efficiency requires more accurate targeting, which is dependent on better, more usable references than that heretofore seen.

C. Increasing battlefield efficiency is important for many reasons, including among other things:

1. Efficiency in target locating and identifying assists in more rapid and certain target destruction;
2. Creation of more effective and certain initiation of the combat fire phase;
3. To reduce ammunition expenditure through better fire control;
4. To improve command, control, communications, and reporting;
5. To designate sectors of fire and observation;
6. Limits combat fire phase to that which is necessary for achievement of combat goals;
7. To help reduce fratricide.

D. The quality of information which flows to a commander rapidly becomes suspect in the chaos of combat, forcing commanders into using makeshift battlefield references once the combat fire phase is initiated. My device can be seen once fighting has obscured the reference points through dust, gas, etc. So long as my device remains visible to friendly forces, commanders may continue to use it with greater efficiency than random physical objects for targeting reference points, due to its capacity to be seen and recognized under normal combat conditions. It follows that a more efficient referencing system will help carry forward the tactical and targeting information as the combat fire phase has begun.

VI. DESCRIPTION OF PRIOR ART

A. Indicator Devices as Reference Points. Other potential indicator devices have not possessed characteristics specifically designed for use in military situations, such as training or combat use. Devices have been patented with the specific purpose of acting as indicator devices, such as U.S. Pat. No. 4,885,857 to Leflet, Dec. 12, 1989. These devices heretofore known suffer from a number of disadvantages:

1. Present day referencing methods rely on any object which may serve as an indicator device or reference point (i.e. an old car or a tree). General objects are not always suited as such for use as reference points in relevant combat conditions, and they would lose their value rapidly in dynamic combat conditions.

2. Survey markers and other indicators of that class are not necessarily appropriate for the use I have described. These devices can be easily detected by oncoming enemy forces, eliminating any surprise advantage. This is especially the case when such markers are placed in an incongruous manner, where they "stand out" from the surrounding terrain.

3. Leflet's two-position indicator is limited by the rigidity of the indicator and its lack of materials which are highly reflective in the infrared Spectrum (called "infrared reflective materials"below) for long distance viewing in common battlefield conditions. It is also precluded from use as a battlefield reference marker due to small size of its preferred embodiment. It lacks any camouflaging system to prevent detection from the rear, inasmuch as it is designed to be attached to a primary object, which would obscure from sight the rear at side of the indicator, rendering it unusable for the conveyance of information. Even if Leflet's indicator is of sufficient size to convey information at a distance, difficulty may be encountered in mounting Leflet's indicator to prevent toppling in harsh weather conditions. The need for secured mountings in harsh conditions, combined with Leflet's size and Inflexibility prevents Leflet's indicator from being adaptable to combat conditions.

B. Targeting Devices as Reference Points. It is conceivable that prior target devices themselves may be used as reference points. However, target devices for practice shooting in darkness have size and heat generation characteristics which render such devices unsuitable as range markers for true battlefield conditions. Without proper camouflage on the enemy side, these units can easily be detected by sight, and the typical heat or light emission patterns generated by them can be detected by enemy forces using heat, light, or magnified sighting or other sensing devices. The enemy forces would then be alerted to the presence of the opposing friendly force, with the loss of any surprise advantage.

1. Examples are the target devices in U.S. Pat. No. 4,260,160 to Ejnell & Arrdal, Apr. 7, 1981; and U.S. Pat. No. 4,422,646 to Rosa, Dec. 27, 1983. The bulk of these devices, created by the need for batteries or other power sources, and heat signature characteristics make the use of such targets as combat range Indicators undesirable.

2. A number of design patents were issued to Dulude. They include the following:

Des. 262,131 to Dulude, Dec. 1, 1981
Des. 262,482 to Dulude, Dec. 29, 1981
Des. 262,819 to Dulude, Jan. 26, 1982
Des. 269,631 to Dulude, Jul. 5, 1983

These patents offered unique designs for gun targets, but did not offer a method of presentation by which the targets may be allocated to specific personnel, nor did they provide for viewing at distances under a wide variety of viewing conditions. Rotation of the targets creates no new perspective or other indicia which can be used for this purpose. When rotated, Des. 262,482 has only two different perspectives. The triangular shape of the preferred embodiment of my device offers 4 different perspectives, each of which can be used to convey different information to the viewer.

VII. OBJECTS AND ADVANTAGES Accordingly, several objects and advantages of my battlefield reference marker are:

A. To provide a means of conveying information at a distance, through the use of a display comprised of various signalling media such as letters, numbers, symbols, or color codes; through the use of infrared reflective material (see below) to allow for viewing in different conditions of visibility; and through the use of camouflage to prevent detection of the device from its rear.

B. To eliminate reliance on the random availability of suitable objects for battlefield reference points. This is achieved by the use of pre-positioned reference markers which can be seen in different combat conditions. This simplifies and brings greater efficiency to the target allocation and acquisition process. My device is superior to the selection of random objects because my device is deployed by that commander. Knowledge of the quantity, type, and location of pre-positioned range markers helps eliminate confusion among friendly forces, and reduces instruction time to such forces. Further, the operation, materials, and design characteristics of my device will improve combat efficiency even after the combat is initiated, so long as the range marker is still standing and otherwise observable by friendly forces.

C. My device improves on other indicator devices through the adoption of the following:

1. My device is superior to the use of survey markers, or other general indicia of location and elevation. Combat can occur in virtually any terrain, and the appearance of an uncamouflaged set of surveying stakes in an isolated area would appear Incongruous and alert the enemy commander to the possible presence of friendly forces.
2. My device 1s superior to Leflet's for a number of reasons:
   a. Camouflage on the enemy side, in order to prevent detection of the range marking device by the enemy commander.
   b. Supporting my device between two vertical supports, such as standard metal fence posts, so that the device is roughly perpendicular to the ground, allows the use of both sides of the device. The Front Planar Surface can then be used to convey information at the same time the Rear Elements are operating to prevent detection by enemy forces.
   c. The use of flexible cloth and cloth-type materials reduces weight and bulk, and makes manufacturing, storage, transportation, and maintenance much easier. My device is designed to be folded into a small bag.
   d. Greater flexibility for ease and speed of setup, and persistence through foul weather conditions.
   e. The use of infrared reflective materials, chemical lights; and colors in different design configurations on the front side for the conveying of information to such friendly forces.
3. As a range marker, my battlefield reference marker is superior than the use of ordinary thermal targets, such as Rosa's, or Ejnell & Arrdal's. The use of enemy-side camouflage, chemical lights and the special lightweight materials discussed herein with their particular thermal characteristics, reduces bulk, speeds set up time, avoids battery or power source failure, and eliminates any tell-tale heat signature. These improvements reduce the chance of detection by enemy forces. It can also be manufactured at much less of a cost than complex battlefield thermal targets.
4. My battlefield reference marker is superior to the projectile targets offered by Dulude. The use of infrared reflective material in different configurations, DAY-GLO $_{TM}$ brightly colored material, chemical lights, and the use of enemy side camouflage, allows for viewing In all anticipated conditions. My preferred embodiment also provides multiple directional indicia, more than the two offered by Dulude and therefore improving on those patents. The number of directional indicia depends on the layout of the infrared reflective material and the DAY-GLO $_{TM}$ brightly colored material fabric in relation to each other.

D. My battlefield reference marker, through the use of differing patterns, colors, and special reflective materials, is designed to convey information at a distance on the battlefield. Therefore, my battlefield reference marker may be used at other times when the conveyance of Information is necessary. For example, different permutations of my battlefield reference marker may be used to guide vehicles through a mine field, or provide other forms of guidance, such as to aircraft. Orientation of the patterns gives a commander a chance to further allocate resources, which would use the information conveyed by the specific orientation to perform a task.

E. Further objects and advantages of my battlefield reference marker will become apparent from a consideration of the drawings and ensuing description.

VIII. DESCRIPTION OF DRAWINGS

In the drawings, closely related figures have the same number but different alphabetic suffixes.

A. FIG. 1 is a perspective front (friendly side) view of my battlefield reference marker.

Figure 2:
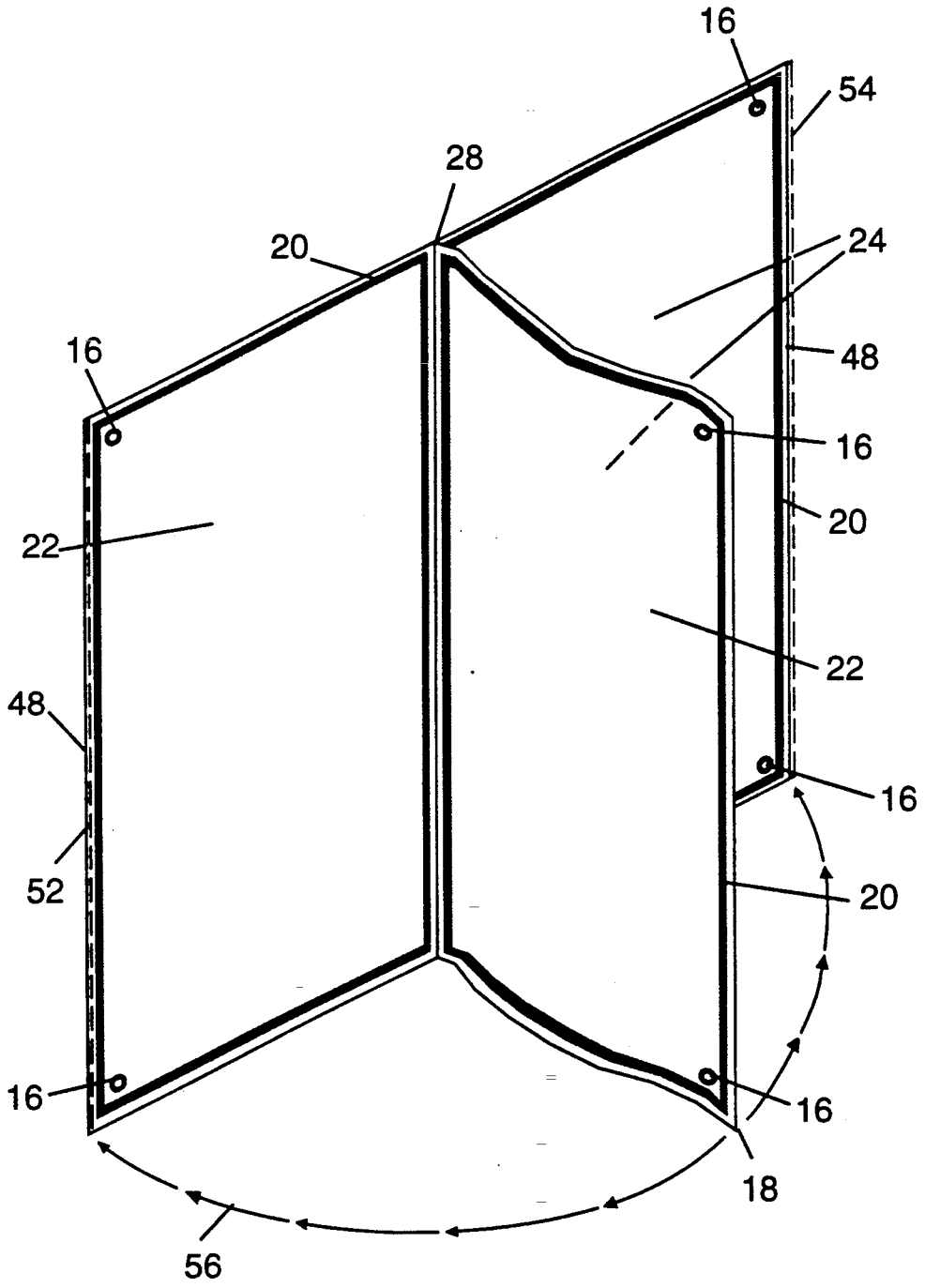
Figure 3:
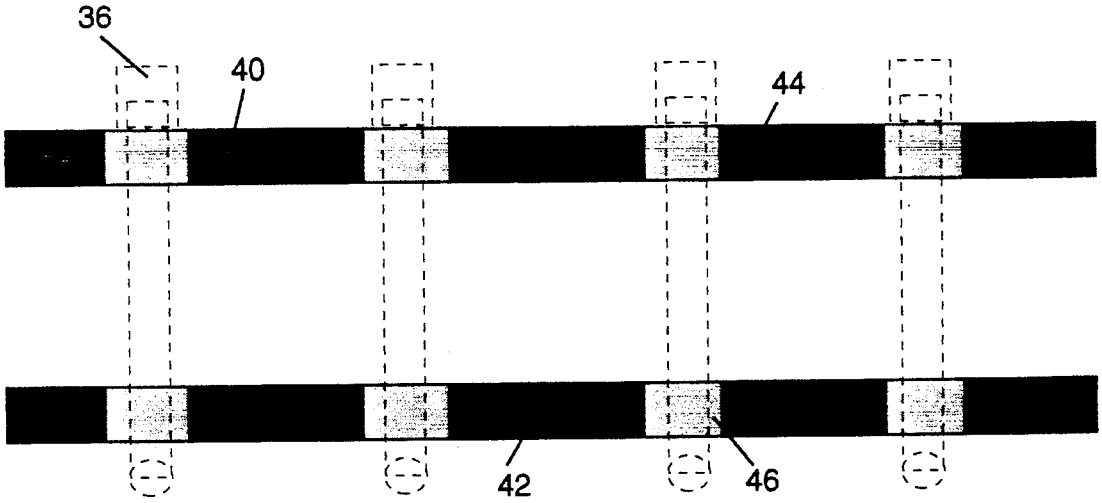

B. FIG. 2 is a perspective rear (enemy side) view of my battlefield reference marker, C. FIG. 3 is a close up view of the chemical light attachment assembly.

Figure 4:
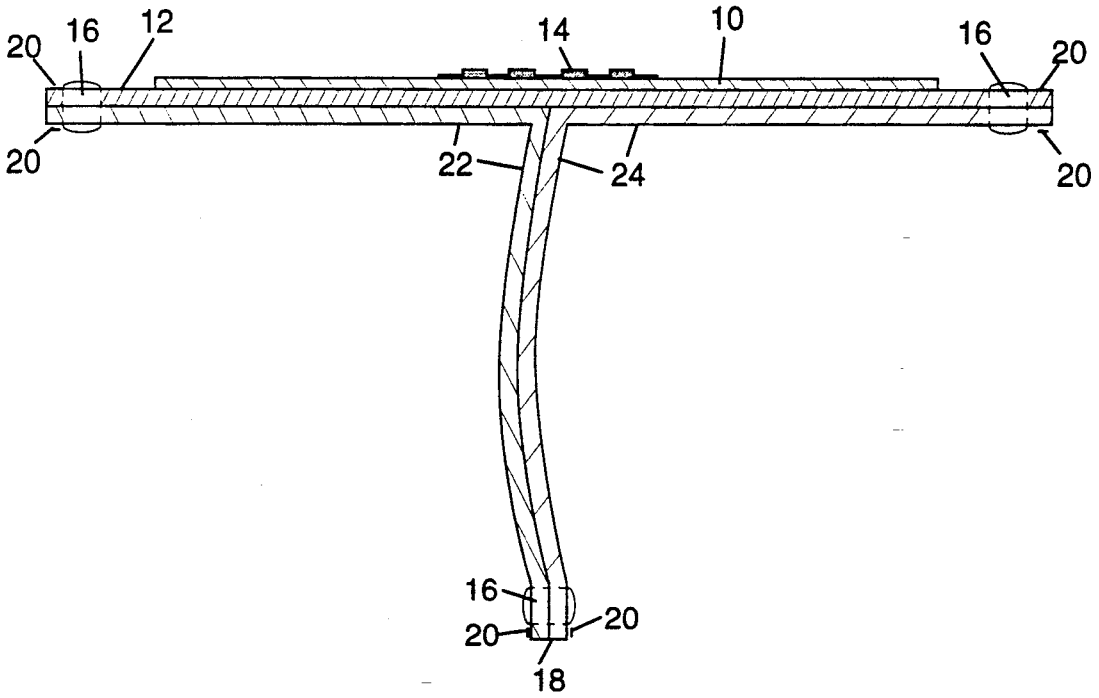

D. FIG. 4 is a sectional view of the main embodiment.

Figure 5A:
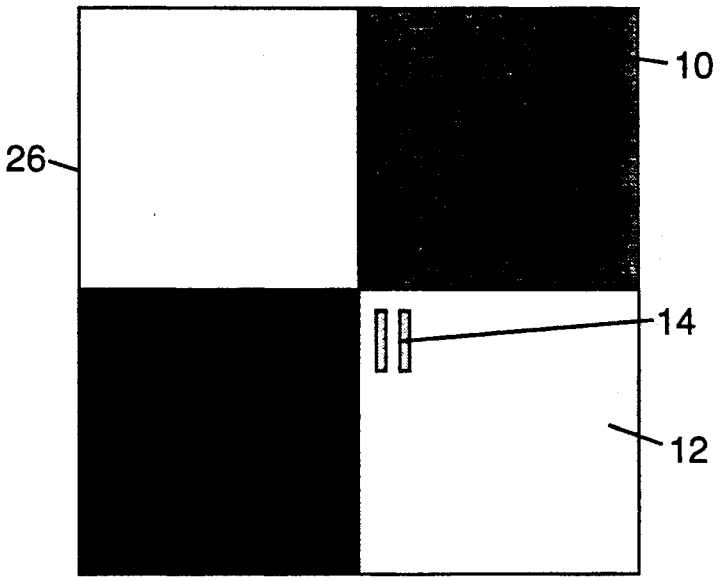
Figure 5B:
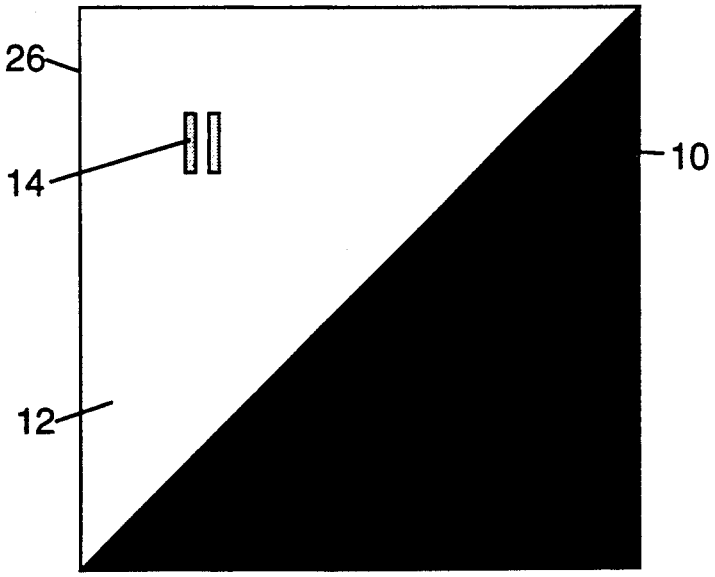

E. FIGS. 5A and 5B are a series of additional friendly side display options.

IX. REFERENCE NUMERALS IN DRAWINGS

10- infrared reflective material
12- DAY-GLO $_{TM}$ brightly colored material Rip-stop Nylon/Cotton/Other lightweight flexible fabric
14- Elastic Chemical Light Attachments
16- Grommet
18- Rear Flap Assembly
20- Hook-and-Loop Fasteners
22- Camouflage Type A
24- Camouflage Type B
26- Front Planar Surface
28- Flap Joint Attachment
30- Front & Rear Panel Attachment
36- Chemical Light Stick
40- Elastic Strip A
42- Elastic Strip B
44- Elastic Strip Attached Area
46- Pocket Area
48- Rear Elements
52- First Signalling Position
54- Second Signalling Position
56- Directional Arrows

X. DESCRIPTION OF INVENTION

A typical embodiment of the present invention is illustrated in FIG. 1 (Front View) and FIG. 2 (Rear View). For the purposes of description, a Front Planar Surface 26 is also known as the Friendly Side, and the Rear Elements 48 are also known as the Enemy Side.

A. The Front Planar Surface 26 of my device consists of a generally rectangular base panel sheet of DAY-GLO brightly colored material Rip-stop nylon/cotton-/other lightweight flexible fabric 12 which is durable and sufficient to meet military specifications.

B. To this sheet, a small layer of the flexible infrared reflective material 10 is attached, in a means which would best secure the Special Material to the base panel. This method may include stitching, lamination, or glue in some manner.

C. The shape chosen for the infrared reflective material 10 may differ, depending on the information to be conveyed by the particular shape chosen. See for example FIGS. 5A and 5B. The infrared reflective material 10 covers a portion of the DAY-GLO $_{TM}$ brightly colored material fabric 12, in an amount to create sufficient contrast between the color of the two types of materials, which contrast allows for viewing at a distance. The size of the panel is determined by the distance from the observer at which it is expected to be used.

D. Attached to Front Planar Surface 26 are two or more closely parallel rows of elastic bands, which comprise the Elastic Chemical Light Attachments 14, and FIG. 3.

1. The location of the Elastic Chemical Light Attachments 14 on Front Planar Surface 26 will be determined by the strength of the means by which Elastic Chemical Light Attachments 14 are affixed to Fronts Planar Surface 26, and to which material (the infrared reflective material 10 or the DAY-GLO $_{TM}$ brightly colored material fabric 12) the Elastic Chemical Light Attachments 14 are to be affixed.
2. The number of parallel rows (two strips of elastic in each parallel row) will be determined by the size of the device, and the anticipated viewing distance.
3. Each Elastic Strip A 40 is of a width sufficient to secure one end of the Chemical Light Stick 36 in the Elastic Strip's Pocket Area 46, and are of a length sufficient to hold the number of Chemical Light Sticks 36 necessary for line of sight acquisition and identification at a given distance. Its similar and corresponding parallel Elastic Strip B 42 is attached at a sufficient distance from elastic strip A 40 so that (he opposing end of the Chemical Light Stick 36 is capable of being secured by the Pocket Area 46 of said Elastic Strip B 42. When inserted, the Chemical Light Sticks 36 run roughly perpendicular to each strip. In FIG. 3, the parallel strips are attached to the front panel at the end of each strip, and at the same occasional intervals on both strips 40 & 42, leaving sufficient gaps for the introduction and secure holding of the requisite number of Chemical Light Sticks 36, so that the Chemical Light Sticks 36 are roughly perpendicular to the parallel Elastic Strips 40 and 42, Each Elastic Strip Attached Area 44 is attached using a means necessary to prevent each strip from disengaging from the Front Planar Surface 26.

E. Around the peripheral edges of the Front Planar Surface 26 is the Front and Rear Panel Attachment 30, securely attaching to the Front Planar Surface 26 to the Rear Elements 48 of the device, shown on FIG. 2; that is, to the edges of Camouflage Type A 22, Camouflage Type B 24, and the Hook-and-Loop Fasteners 20. The Flap Joint Attachment 28 in FIG. 2 may also be attached to the Front Planar Surface 26 for additional strength.

F. At the four corners of the Front Planar Surface 26 Grommets 16 are used, for the attachment of the device by cord, rope, straps, wire, or other means, to poles or other objects being used to keep the assembly upright and generally perpendicular to the ground. On FIG. 2, the Rear Flap Assembly 18 also contains two Grommets 16, on the corners opposite the Flap Joint Attachment 28. Other grommets may be added to the device as necessary for additional stability.

G. The Rear Flap Assembly 18 is approximately one-half (½) the length of the device. One side of the Rear Flap Assembly 18 is comprised of a panel of Camouflage Type A 22. Adjacent to this panel, and flush against the rear of the Front Planar Surface 26, is a similar panel of Camouflage Type A 22. Around the peripheral edge of each side of the Rear Flap Assembly 18 is a strip of Hook-and-Loop Fasteners 20. Around the periphery of the Rear Elements 48 of the entire device is an opposing Hook-and-Loop Fastener 20 strips. Upon pivoting the Rear Flap Assembly 18 along its axis (that is, along its Flap Joint Attachment 28), the Hook-and-Loop Fastener 20 strips on the Rear Flap Assembly 18 periphery meet and match their counterpart Hook-and-Loop Fastener 20 strips along the peripheral edge of the adjoining Rear Elements 48 of the device. Additional hook-and-loop strips may be necessary along the axis of the rear flap for added sealing effects. The Hook-and-Loop Fasteners 20 operate to seal the periphery between the edge of the Rear Flap Assembly 18 and the Rear Elements 48, helping prevent damage to the device from flapping and other windsock effects.

H. The second side of the Rear Flap Assembly 18 is comprised of Camouflage Type B 24, with similar Hook-and-Loop Fastener 20 strips running the length of each peripheral edge of the Rear Flap Assembly 18, and with opposed attaching Hook-and-Loop Fastener 20 strips on the Rear Elements 48 around the periphery of the half-panel of Camouflage Type B 24.

XI. OPERATION OF BATTLEFIELD REFERENCE MARKER

A. The Front ("Friendly Side") View. The front of my battlefield reference marker is designed for visibility under all four conditions, eliminating the need for multiple sets of reference markers. The size of my device will vary, depending on the distance which is to be ranged. The front side configuration of the infrared reflective material and DAY-GLO$_{198}$ brightly colored material will be determined by Information sought to be conveyed.

1. Day - clear: Using binoculars or the naked eye, my battlefield reference marker uses a combination of DAY-GLO$_{198}$ brightly colored material will black, designed for maximum visibility at number of distances in open terrain. The visual offset add contrast between the DAY-GLO$_{198}$ brightly colored material color used and the jet black of the infrared reflective material (as it appears in visible light), provides for easier discrimination of the marker at a distance.
2. Day & Night - occluded: These conditions normally require the use of thermal signature viewing devices ("thermal sights"), or other optically assisted viewing devices. My battlefield reference marker uses a infrared reflective material, which appears visible through such viewing devices. When viewed through different imaging devices used by the military, the infrared reflective material displays certain polarity and heat signature characteristics which make such infrared reflective material easily distinguished through such sights This is accomplished by the infrared reflective material without the use of any electrical or other power devices being attached to the infrared reflective material,
   a. The infrared reflective material is available from the following suppliers:
   TVI Energy Corporation 9570-A Berger Road Columbia, Md. 21046 (410) 381-3701
   or Monterey Bay Company P.O. Box 1538Columbia, Md. 21044 (301) 596-9797 b. The absence of any need for a power device is a desirable element of my battlefield reference marker, inasmuch as the need to carry heavy generators or batteries is difficult, and the use of a heat or infrared generator may be detectable by enemy sensing devices. If so detected, the reference marker may act to warn enemy forces, and so defeat the purpose of a pre-designed set of battlefield reference markers. Once alerted, enemy forces could circumvent the battlefield entirely, or contrive to use the markers to their own advantage to defeat friendly forces.

3. Night- clear: Used under this battlefield condition, my battlefield reference marker allows the use of typical military viewing methods; naked eye, passive night vision devices (NOD), binoculars, and thermal sights. The attachment of light emitting chemical devices allows naked eye, NOD, and binocular viewing. Targets approaching the reference marker will not be able to see the faint glow from the chemical device, nor will they be able to detect any heat signature from the chemical interaction inside the chemical lights, which is insignificant at best. Any light or heat generated by the chemical lights is masked by the Front Planar Surface 26 of my battlefield reference marker. The number of chemical lights used, and their precise placement on my device, will depend on the size of my battlefield reference marker and the distance at which viewing is anticipated. Chemical light devices can be obtained from:

American Cyanamid Co. Charlotte, N.C. 28214
or
Chemical Device Corp.
Novato, Calif. 94949

4. Different sizes, color patterns, and the configuration or design of the materials, may be chosen. The different colors and configurations can then be assigned to different personnel/units.

a. The pattern of the infrared reflective material as it relates to the whole marker can be tailored, with each orientation identifying a reference marker as assigned to specific friendly units. For example, a triangular configuration may be used, with the infrared reflective material 10 forming an equilateral triangle with its base completely along one edge of the Front Planar Surface 26, and with the point of the triangle midway along the opposite edge of the base. By placing the point of the triangle to the left, right, up, or down, a commander can further improve combat efficiency by allocating a specific directional indication to different personnel, under his or her command.

b. The size of the marker, and the concomitant size of its constituent elements, will depend on the distance at which the range marker is to be placed.

B. The Rear ("Enemy Side") View.

1. The rear side of my battlefield reference marker operates by presenting to the enemy a visual camouflage display, which shields from view any negligible light or heat emitted by the chemical light devices. It also prevents visual detection of the Battlefield Range Marker by enemy forces until such forces are well into the range of friendly armaments, allowing allocation of each enemy target to appropriate friendly personnel for destruction.

2. The two camouflage types on the Rear Flap Assembly 18 and on each appurtenant Rear Element 48 (i.e. FIG. 2), allow friendly forces to deploy my battlefield reference marker In one of two different terrains. For example, Camouflage Type A 22 may be Woodland style fabric, and Camouflage Type B 24 may be Desert style camouflage fabric. The two types of camouflage displayed will depend on the anticipated deployment of friendly forces. Other combinations may include Arctic and Woodland; Arctic and Desert; Arctic and Jungle; Woodland and Jungle; Desert and Jungle; etc.

C. Deployment. The deployment team deploys my device in the following manner

1. The team positions my device In such a manner as to present itself within the line of sight of friendly forces, subject to terrain and other topographical conditions. Mere occluded conditions caused by fog, clouds, dust, gas, or other airborne elements are Irrelevant to the placement of the device.

2. The team positions the device with the Front Planar Surface 26 facing friendly forces and within line of sight viewing. The team rotates the device so that the preferred design configuration presents itself, depending on the information desired to be conveyed to the friendly forces for example, a triangle superimposed on the rectangle of the Front Planar Surface 26 may be pointed up, down, left, or right, allowing the conveyance of four bits of information.

3. The team pivots the Rear Flap Assembly 18 along its Flap Joint Attachment 28, so that the preferred camouflage type is presented to the enemy forces. The choice of camouflage will depend on field conditions. The Rear Elements 48 operate as follows:

a. The Rear Flap Assembly 18 covers a first area of Camouflage Type A 22 or a second area of Camouflage Type B 24 when the Rear Flap Assembly 18 is in its First Signalling Position 52 and Second Signalling Position 54 respectively. FIG. 2 shows, by the Directional Arrows 56, the Rear Flap Assembly 18 being moved from its First Signalling Position 52 covering the first area of Camouflage Type A 22, to its Second Signalling Position 54 covering the second area of Camouflage Type B 24. Of course, the Rear Flap Assembly can be moved from its First Signalling Position 52 to its Second Signalling Position 54, and can be moved back and forth as many times as camouflage needs dictate. In each position, the Rear Flap Assembly 18 is releasably held by Hook-and-Loop Fasteners 20 placed in opposing strips along the periphery of the Rear Flap Assembly 18, and its opposing Rear Element 48.

4. Rotating the panel and pivoting the Rear Flap 18 along its hinge is performed manually, and the camouflage colors are carried directly on the surfaces mentioned.

5. The Hook-and-Loop Fasteners 20 on the Rear Flap 18 are pressed against their counterpart on the opposing Rear Element 48 so that the Hook-and-Loop Fasteners 20 seal off a chamber containing the unused camouflage type. The Grommets 16 on the Rear Flap Assembly 18 are placed next to the Grommets 16 on the opposing Rear Elements 48, so that the holes in the Grommets 16 are In line and contiguous, allowing for cord or other means of suspension to be passed immediately through both holes.

6. Cord or other means of attachment (not shown) are then run through and tied to the Grommets 16, including the Grommets 16 on the Rear Flap Assembly 18 which are now adjacent to two corners of the device. My battlefield reference marker is then suspended between any available and appropriate vertical object (not shown), with the method of attachment securing its four corners to the vertical object on its corresponding side, so the surface planes of the front and rear sides are roughly perpendicular to the ground.
7. For use at night, the appropriate number of Chemical Light Sticks 36 are then activated and inserted in the elastic strips, the number being determined by the distance between my device and the friendly forces.

XII. EMBODIMENTS

The preferred embodiment of my device is as a reference point for the targeting of objects, with the infrared reflective material configured as a triangle, with the triangled displayed to the friendly side in a manner which is designed to convey specific information. However, my device may be used any time specific information can be visibly conveyed through the multiple design configurations allowed on the friendly side of my battlefield reference marker. The benefits of being detectable in all conditions, described above, will continue to apply. This allows such applications as:

A. Marking of friendly vehicles and positions to allow observation by friendly forces and assist in the prevention of fratricide.

B. Marking of lanes, routes, obstacles, and logistical supplies during training or combat operations. For example, my battlefield reference marker can be used to direct forces through a mine field.

C. Marking of unit boundaries, coordination and contact points during training or combat operations.

XIII. CONCLUSION, RAMIFICATIONS AND SCOPE

A. Accordingly, the reader will see that my battlefield reference marker eliminates the need for identification of a much higher number of reference markers or reference points, because the friendly view of my reference marker can be seen by friendly commanders in all four battlefield conditions. My reference marker 1s camouflaged from the enemy view, to prevent enemy forces from detecting the reference marker, and becoming alerted to the designation of their assets as targets.

B. The absence of a power device, combined with my rear view camouflage system, creates a battlefield reference marker which 1s undetectable by enemy forces until it is too late for them to take corrective action. At that point, the enemy force would already have been identified, and would have become allocated as a target to specific friendly forces by referral of Individual targets to the reference marker.

C. While there may be certain benefits to the use of random objects as reference markers, the net effect of my battlefield reference marker is an improvement in combat command and control, and an improvement in battlefield efficiency.

D. Although the description above contains many specifics, these should not be construed as limiting the scope of the battlefield reference marker but as merely providing illustrations of some of the presently preferred embodiments of this Intention. For example, the infrared reflective material can have other shapes; chemical light sticks may not be used; the Elastic Chemical Light Attachments eliminated, etc. Also, my battlefield reference marker may be used any time specific information can be visibly conveyed through the multiple design configurations allowed on its friendly side. This allows such applications as the marking of friendly vehicles and positions to allow observation by friendly forces and assist in the prevention of fratricide; marking of lanes through mine fields, routes, obstacles, and logistical supplies during training or combat operations. Other uses may be the marking of unit boundaries, coordination and contact points during training or combat operations.

E. Thus the scope of the battlefield reference marker should be determined by the appended claims and their legal equivalents, rather than by the examples given.

What is claimed is:

1. A signal device adapted for suspension between two near vertical objects, comprising:

a. a first, generally rectangular front planar surface of flexible, brightly colored material of a first size;

b. a second material having properties which allow for recognition by thermal imaging viewing devices, and having a predetermined shape and a predetermined size, said predetermined size being smaller than said first size, said second material being of a color which allows sharp contrast to the naked eye between said brightly colored material and said second material;

c. a means of attaching said second material to said front planar surface;

d. at least one set of two parallel strips of elastic material, and means for attaching said elastic strips to said front planar surface, said parallel elastic strips placed apart a distance approximately equivalent to the length of a standard chemical light device, said parallel elastic strips each being attached in periodic intervals, said periodic intervals being the same on each individual elastic strip of the set, allowing unattached areas of similar periodic intervals on each strip, each of said unattached areas of sufficient length to allow the insertion and the secure holding of one end of said chemical light device between one individual elastic strip and its appurtenant area of said front planar surface;

e. a rear element, said rear element comprising two equal parts of different signaling media, and means for securing said rear element to said front planar surface;

f. a rear flap assembly having two major opposed panel surfaces;

g. means for attaching and pivotally mounting said rear flap assembly along an intersection of said different signalling media, and adapted to be rotated between two different signaling positions against each of the different signalling media;

h. means for sealing the periphery of said rear flap assembly after said rotation, against the periphery of one of the different signalling media, against which said rear flap assembly is rotated, and;

i. means for securing said signal device between two vertical supports.

* * * * *